United States Patent [19]

Krapfenbauer

[11] 4,388,818

[45] Jun. 21, 1983

[54] METHOD AND APPARATUS FOR FABRICATING PRECISION TEETH

[75] Inventor: Hans Krapfenbauer, Zurich, Switzerland

[73] Assignee: Firma Ernst Grob, Männedorf, Switzerland

[21] Appl. No.: 299,399

[22] Filed: Sep. 4, 1981

[30] Foreign Application Priority Data

Oct. 20, 1980 [CH] Switzerland ..... 7807/80

[51] Int. Cl.[3] ..... B21H 5/00

[52] U.S. Cl. ..... 72/81; 72/95; 72/190; 72/240

[58] Field of Search ..... 72/95, 100, 102, 190, 72/240, 81

[56] References Cited

U.S. PATENT DOCUMENTS 3,713,315 1/1973 Meyer et al. ..... 72/95

FOREIGN PATENT DOCUMENTS 1294912 7/1964 Fed. Rep. of Germany ..... 72/95

*Primary Examiner*—Lowell A. Larson

*Attorney, Agent, or Firm*—Werner W. Kleeman

[57] ABSTRACT

An approximately shaped or formed gear is fabricated in any desired way and is then corrected by means of substantially ring-shaped rolls or rolling tools performing striking or hammering operations in the tooth gaps of such gear. The rolls rotate in a planetary fashion in revolving rolling or roller heads. Such rolling heads are advanced to a maximum radial penetration depth of the rolls which is governed by a stop and are then retracted, if necessary. The advance or feed is preferably performed by a hydraulic drive, the pressure of which is regulated electro-hydraulically by means of a template or the like. The hydraulic drive acts against the action of a spring. The approximately formed teeth, which are thus rolled in an overlapping manner, are produced by the addition of material per tooth flank. Preferably, such material addition amounts to at least twice or three-fold the summation pitch error according to DIN 3960 to 3962 (German Industrial Standard 3960 to 3962). The above-mentioned pressure-controlled advance or retraction undertaken against the action of spring force is preferably accomplished along a maximum path or distance of 0.25 mm. This distance is frequently smaller than 0.1 mm. Precision teeth are produced which frequently no longer even have to be ground.

11 Claims, 5 Drawing Figures

METHOD AND APPARATUS FOR FABRICATING PRECISION TEETH

CROSS-REFERENCE TO RELATED APPLICATION

This application is related to my commonly assigned U.S. application Ser. No. 69,391, filed Aug. 24, 1979, now U.S. Pat. No. 4,307,572 granted Dec. 29, 1981.

BACKGROUND OF THE INVENTION

The present invention relates to a new and improved method for fabricating precision teeth and to an apparatus for the performance of such method.

Generally speaking, the method of the invention serves for fabricating precision teeth with at least one free tooth end, wherein there is initially produced a workpiece with approximately shaped teeth, which are then finished rolled in a separate working cycle by cold forming or working.

The apparatus for the performance of the inventive method comprises a machine frame, at least one rolling head carriage mounted therein and displaceable with a linear crosswise or transverse motion with respect to the workpiece. In the rolling head carriage there is mounted a revolvingly drivable rolling head at which there is rotatably mounted at least one roll. This apparatus further comprises a workpiece holding device which is drivable in the lengthwise and rotational direction with respect to the feed or advance of the workpiece. There also is provided a drive synchronization for synchronizing the rolling head drive with the workpiece feed or advance, and a hydraulic drive for feeding or advancing the rolling head carriage towards the workpiece up to a stop and back into a rest position.

As a preliminary observation it should be mentioned that precision teeth can be produced by cold rolling from the solid material according to the known method of the assignee of this application, as disclosed, for instance, in German Pat. No. 1,016,222. These precision teeth do not require any post treatment of the type described in the present disclosure.

With teeth produced in a different manner, whether such be by cutting or non-cutting machining cycles, it is necessary to carry out post-treatments by cutting or non-cutting methods, for instance, by substantially gear-shaped tools, in order to achieve high precision and good surface quality. During the generating of the workpiece material can be shifted or repositioned towards the pitch circle, on the running-in flank, and away from the pitch circle, on the running out flank, thus leading to an asymmetry. Both in the case of machining in a cutting manner with substantially gear-shaped tools meshing with the teeth, as by abrading or scraping, or in a non-cutting manner, as with finish generating, the tools tend to follow the inaccuracies of the teeth so that their corrective effect is not sufficient. The fabrication of such tools is very expensive and requires many tests for determining their shape or form. Furthermore, it is possible that the surface of the approximately shaped teeth, for instance, when manufacturing the approximately shaped teeth by broaching, is such that such cannot be worked by scraping or finish generating but have to be ground.

SUMMARY OF THE INVENTION

Therefore, with the foregoing in mind it is a primary object of the present invention to provide a new and improved method and apparatus for fabricating precision teeth in an economical manner and which is not associated with the aforementioned drawbacks and limitations of the prior art.

Now in order to implement these and further objects of the present invention, which will become more readily apparent as the description proceeds, the method of the present development is manifested by the features that the teeth are approximately fabricated by means of an overmeasure or addition of material. Thereafter, the teeth are clamped for cold working thereof and there is undertaken a feed of the workpiece. The workpiece is thereby displaced along its lengthwise axis and rotated about such lengthwise axis. The workpiece is machined from the outside by means of substantially ring-like profiled rolling tools revolving in a planetary-wise fashion in a rooling head. The machining step encompasses performing at the tooth spaces or gaps in the same directional sense, which predominantly extends in the teeth lengthwise direction, individual rolling operations which are briefly effective in rapid sequence and accommodated to the tooth pitch-dependent workpiece feed, so that with the same rolling tool there are applied in the tooth gaps in succession successively performed individual rolling operations each located at a substantially screw-line shaped zone which is governed by the feed of the workpiece. There are performed in the teeth lengthwise direction of the same tooth space successive individual rolling operations which overlap with respect to the application of the individual rolling operations at the workpiece, there is gradually adjusted the penetration depth of the rolls during the feed of the workpiece such that at each end region of the teeth adjacent to a free toothed end such penetration depth is smaller than at the remaining zones.

The apparatus according to the invention for the performance of such method is of the type comprising a machine frame, at least one rolling head carriage mounted therein and displaceable in linear crosswise or transverse motion with respect to the workpiece. In the rolling head carriage there is mounted a revolvingly drivable rolling head in which there is mounted at least one roll. Such apparatus further comprises a workpiece holding device which is drivable in the lengthwise and rotational direction with respect to the feed or advance of the workpiece, a drive synchronization means for synchronizing the rolling head drive with the workpiece feed or advance, and a hydraulic drive for feeding or advancing the rolling head carriage towards the workpiece up to a stop and back to a rest position.

With the method and apparatus according to the invention there can be achieved a high precision and quality of the teeth, rendering superfluous any scraping and often even grinding. The qualitative value of teeth fabricated according to the invention is similar to those fabricated according to the known method of the assignee of this application. This is true even for cases where no scraping is possible for the aforementioned reasons.

Thus, it is now possible to fabricate precision teeth of the type produced according to assignee's technique, even in cases where such teeth up to the present have not been fabricatable or have not been fabricated.

With the fabrication of the approximately shaped teeth the overmeasure or addition of material per tooth flank can be very moderate, but should at least be equal to the summation pitch error, preferably even double or triple this amount. Consequently, there can be avoided incompensatable errors of the approximately shaped teeth.

It has been found that at the end region of teeth there is less resistance to the rolling than at a region located further inwardly, so that a lengthwise tooth crown is produced which normally exceeds the desired amount.

By means of a smaller radial penetration depth of the rolls at the end region of the teeth such excessive tooth crown of the teeth can be avoided. This penetration depth difference is virtually always considerably smaller than 0.25 mm and frequently even smaller than 0.1 mm.

The gradual precise feed or advance has been found to be extremely problematic, since even the slightest differences at the normally used hydraulic drives can lead to major errors.

Also, the hydraulic system has to be able to fully counteract the enormous forces which inevitably occur during the rolling work and to fulfill its original function of advancing or feeding the rolling heads to the working position and back again to the rest position.

Hence, with the method according to the invention, the greatest penetration depth is defined by a conventional stop. Furthermore, the penetration depth is advantageously regulated by electro-hydraulic control means. In addition, it is preferable to perform such regulation by means of a hydraulic drive which acts against the effect of spring means.

With the apparatus described herein such problem has been solved by providing a spring which acts against the feed or advance movement and a regulatable pressure control of the hydraulic drive during the advance or feed.

Preferably such apparatus contains a scanning or feeler device for controlling the pressure according to a pattern or control cam. This cam can be stored, for instance, electronically. In order to simplify the manufacturing and the correction work a cam which has its body formed in a predetermined manner is advantageously used as a pattern, which can be scanned, for instance, by means of an electrical adjusting resistor or a linear displacement path transmitter. The scanning element and/or the cam can thus be moved in synchronism with the lengthwise workpiece motion and can be retracted to the original position after a rolling or direct forming operation. This can be performed by automatic means.

According to the invention the pressure control is also preferably perfected by electro-hydraulic means, for instance, by employing a pre-controlled pressure reducing valve, and the measures described in conjunction with the method can be employed.

BRIEF DESCRIPTION OF THE DRAWINGS

The invention will be better understood and objects other than those set forth above will become apparent when consideration is given to the following detailed description thereof. Such description makes reference to the annexed schematic drawings which show an exemplary embodiment of the invention wherein.

DETAILED DESCRIPTION OF THE PREFERRED EMBODIMENTS

Figure 1:
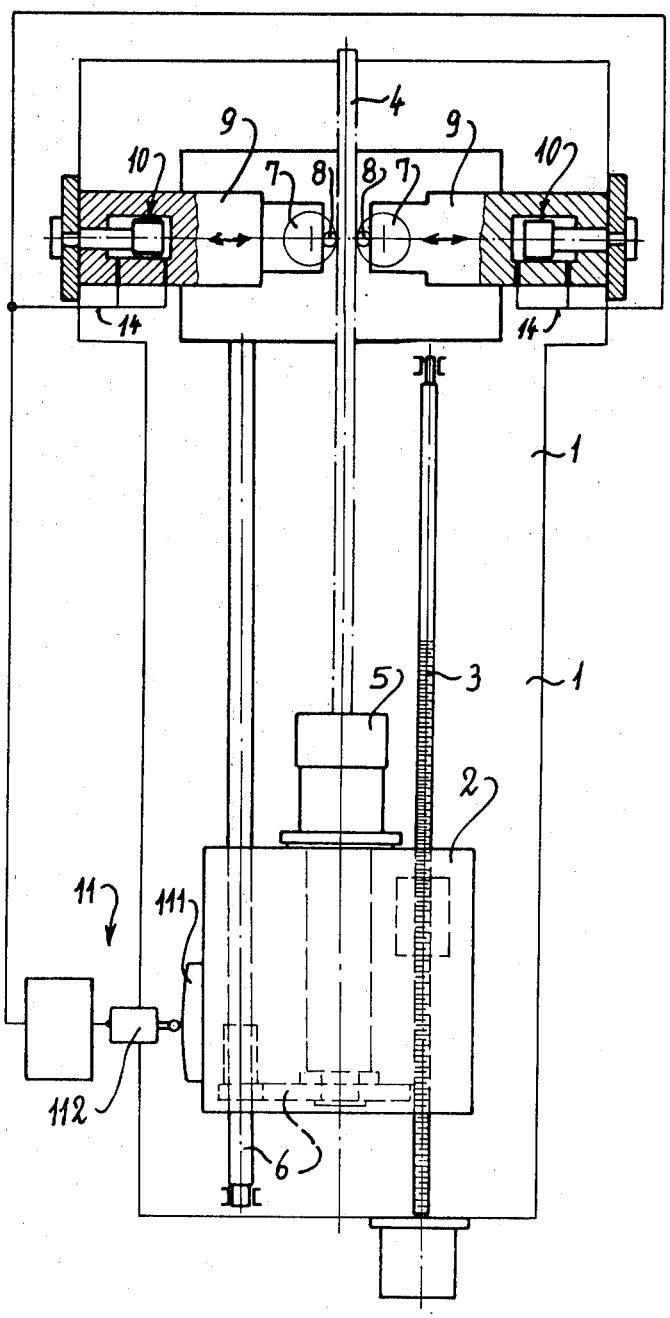
FIG. 1 is a schematic top plan view of an apparatus according to the invention.
Figure 2:
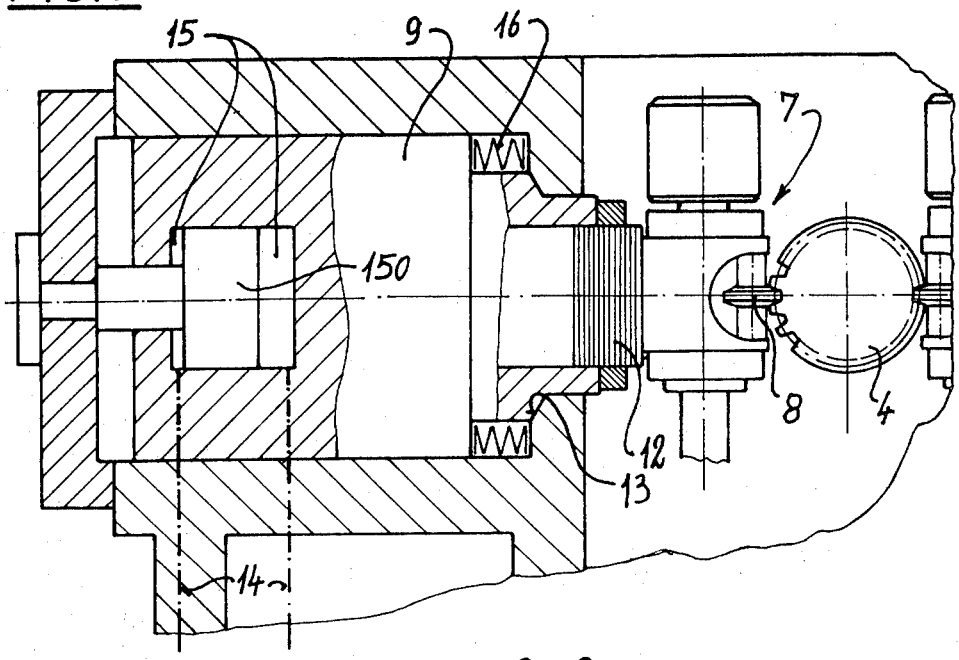
FIG. 2 is a schematic and enlarged cross-sectional view transversely of the workpiece and a rolling head carriage or slide containing the rolling head.
Figure 3:
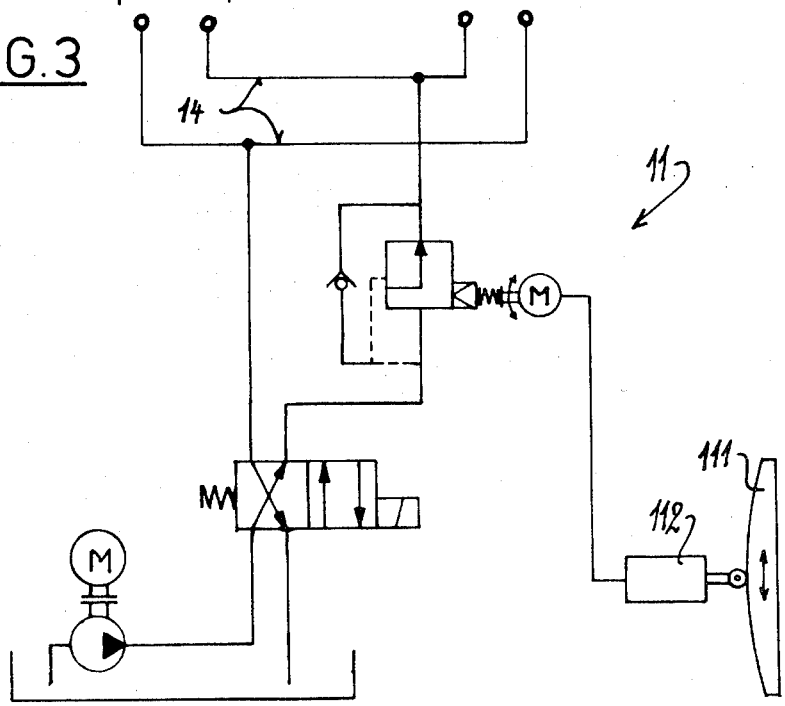
FIG. 3 is a schematic circuit diagram of an electrohydraulic control.

Describing now the drawings, the machine frame 1 shown in FIGS. 1 and 2 will be seen to support a workpiece clamping or chucking carriage 2, as best seen by referring to FIG. 2. The clamping carriage 2 accomplishes the axial feed or advance of the workpiece 4 by means of a threaded spindle 3 or equivalent structure. For this purpose the workpiece 4 is chucked or clamped in a chucking or clamping head 5 of the workpiece clamping carriage 2. The chucking or clamping head 5 is rotatably drivable by means of suitable gearing or drive 6, and the synchronization of such rotational movement of the workpiece 4 with the movement of the rolling heads 7 is accomplished by a here not further illustrated but conventional synchronous drive or gearing provided in the machine frame 1. The rolling heads 7 each contain rolls or forming tools 8 and are mounted in a related rolling head carriage 9, regulatable by hydraulic means with respect to its advance or feed with respect to the workpiece 4, and thus, as concerns the penetration depth of the rolls or forming tools 8 in the workpiece 4. Such regulation or control is performed, for instance, by means of the electro-hydraulic control 11 indicated in FIG. 1 and shown in greater detail in FIG. 3.

As can be seen by referring to FIG. 2, each rolling head 7 is adjustable or regulatable as to its base position by means of a thread or threaded portion 12 provided in the rolling head carriage 9, so that the maximum penetration depth of the roll or forming tool 8 is only governed by the stop or impact means 13, against which bears the rolling head carriage 9, as shown in FIG. 2.

Figure 4:
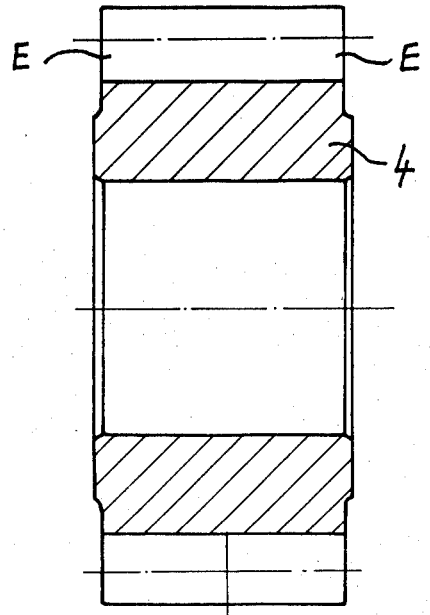
FIG. 4 is a longitudinal sectional view of a gear.
Figure 5:
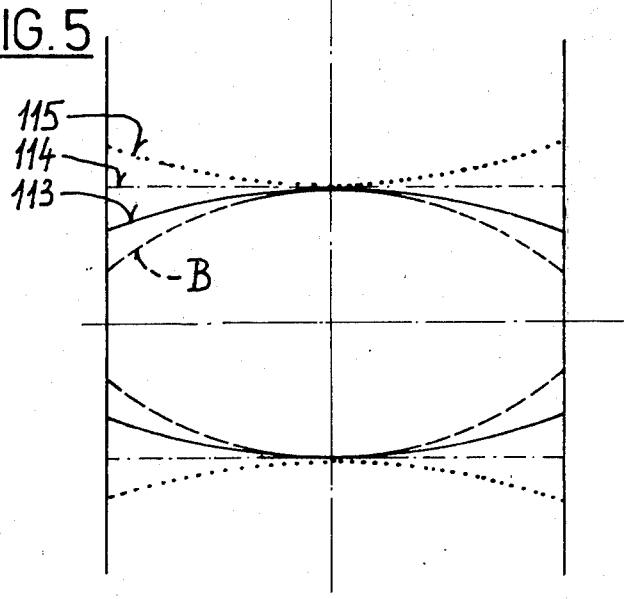
FIG. 5 is an enlarged top plan view of a tooth of a gear, wherein there have been shown various degrees of tooth crown.

If the entire rolling or direct forming operation were carried out in a known manner, with the rolling head carriage 9 resting against the stop 13, a material shift or repositioning would be generated at the end regions E of the teeth shown in FIG. 4. This would lead to an excessive tooth crown as represented by the curve B depicted in FIG. 5.

According to the invention such undesired tooth crown is avoided by maintaining the penetration depth of the roll 8 in the workpiece 4 smaller at the end region E of the teeth than in the remaining regions or zones. For this purpose there may be employed a template curve or cam 111 which is secured to the clamping carriage 2 and is scanned by a suitable transmitter or pick-up 112. As a function of the result of such scanning operation the control 11 regulates the oil pressure in the cylinder unit 15 of the stationary piston 150 via the hydraulic circuit or lines 14 such that depending upon the compensation or equalization of such oil pressure and the force of the spring 16 the rolling head carriage 9 is positioned more or less closely to the stop or impact means 13, and finally, bears against such stop or impact means 13 when the rolling or direct forming of the intermediate or middle section of the teeth is being performed.

If a gear of the type shown in FIG. 4 is to be rolled, the rolling or direct forming operation will be started with a small penetration depth of the rolls 8 in the workpiece 4 and will be continued up to the stop or impact means 13 shown in FIG. 2, and then for the rolling of the other end region E of the gear the carriage 9 will be retracted from the stop 13. Hence, the movements of the rolling head carriages are very small and, as a rule, below a displacement length or stroke of 0.25 mm.

While there are shown and described present preferred embodiments of the invention, it is to be distinctly understood that the invention is not limited thereto, but may be otherwise variously embodied and practiced within the scope of the following claims. Accordingly,

What I claim is:

1. A method for fabricating precision teeth with least one free tooth end at which there is first fabricated a workpiece with approximately shaped teeth, which are then finished rolled in a separate working cycle by cold working the teeth, comprising the steps of:

approximately fabricating the teeth by means of an addition of material;

clamping said teeth for cold working thereof and performing a feed of the workpiece;

during such workpiece feed displacing the workpiece along its lengthwise axis and rotating such workpiece about said lengthwise axis;

during such movements of the workpiece machining the workpiece from the outside by means of substantially ring-shaped profiled rolling tools revolving in a substantially planetary-like manner in related rolling heads;

said machining step encompassing performing with each rolling tool in the tooth gaps in the same directional sense which predominantly extends in the teeth lengthwise direction individual rolling operations which are briefly effective in rapid sequence and accommodated to the tooth pitch-dependent workpiece feed, so that with the same rolling tool there are applied in the tooth gaps in succession successively performed individual rolling operations each located at a substantially screw-line shaped zone which is governed by the feed of the workpiece;

performing in the teeth lengthwise direction of the same tooth gap successive individual rolling operations which overlap with respect to the application of the individual rolling operations at the workpiece; and gradually adjusting the penetration depth of the rolling tools during the feed of the workpiece such that at each end region of the teeth adjacent to a free tooth end such penetration depth is smaller than at the remaining regions.

2. The method as defined in claim 1, wherein:

the addition of material per tooth flank is at least equal to the summation pitch error according to DIN 3960 to 3962.

3. The method as defined in claim 2, wherein:

the addition of material is at least double the value of the summation pitch error.

4. The method as defined in claim 2, wherein:

the addition of material is at least thrice the value of the summation pitch error.

5. The method as defined in claim 1, wherein:

the maximum difference of the radial penetration depths amounts to less than 0.25 mm.

6. The method as defined in claim 1, wherein:

the greatest penetration depth is determined by a stop.

7. The method as defined in claim 1, wherein:

the penetration depth is regulatable by electrohydraulic control means.

8. The method as defined in claim 1, wherein:

an enlargement of the penetration depth is accomplished by a hydraulic drive acting against the effect of spring means.

9. An apparatus for forming precision teeth at a workpiece, comprising:

a machine frame;

at least one rolling head carriage mounted in said machine frame and displaceable with a substantially linear crosswise motion with respect to the workpiece;

means for displacing said rolling head carriage;

a revolvingly driveable rolling head mounted in said rolling head carriage;

at least one roll tool rotatably mounted in said rolling head carriage;

a workpiece holding device driveable in lengthwise and rotational direction with respect to the feed of the workpiece;

a stop provided for said rolling head carriage;

a hydraulic drive for feeding the rolling head carriage towards the workpiece up to said stop and back into a rest position;

at least one spring counteracting the feed of the rolling head carriage; and pressure control means provided for said hydraulic drive and which are regulatable during the feed of the rolling head carriage.

10. The apparatus as defined in claim 9, further including:

a scanning unit for controlling the pressure of the pressure control as a function of a control curve.

11. The apparatus as defined in claim 9, wherein:

said pressure control comprises an electrohydraulic control.

* * * * *